US006030300A

United States Patent [19]

Zheng

[11] Patent Number: 6,030,300

[45] **Date of Patent: *Feb. 29, 2000**

[54] COLLAPSIBLE STRUCTURES

[75] Inventor: Yu Zheng, Covina, Calif.

[73] Assignee: Patent Catergory Corp., Walnut, Calif.

[ * ] Notice: This patent is subject to a terminal disclaimer.

[21] Appl. No.: 09/162,304

[22] Filed: Sep. 28, 1998

Related U.S. Application Data

[63] Continuation of application No. 08/835,730, Apr. 11, 1997, Pat. No. 5,816,954.

[51] Int. Cl.[7] ..... A63B 67/00

[52] U.S. Cl. ..... 473/471; 473/471; 473/472; 135/125; 135/126; 273/350; 273/398

[58] Field of Search ..... 473/471, 472, 473/479, 481, 485, FOR 100, 101; 273/350, 398, 400, 401, 402; 135/125, 126, 128

[56] References Cited

U.S. PATENT DOCUMENTS

| | | | |
|---|---|---|---|
| 3,561,762 | 2/1971 | Russell | 273/396 |
| 3,580,578 | 5/1971 | McCarthy | 473/471 |
| 3,656,749 | 4/1972 | Reyes | 473/485 |
| 3,895,801 | 7/1975 | Baird | 273/350 |
| 3,960,161 | 6/1976 | Norman | 135/126 |
| 3,990,463 | 11/1976 | Norman | 135/126 |
| 4,825,892 | 5/1989 | Norman | 135/126 |
| 4,858,634 | 8/1989 | McLeese | 135/126 |
| 5,038,812 | 8/1991 | Norman | 135/104 |
| 5,054,791 | 10/1991 | Ball | 273/396 |
| 5,163,461 | 11/1992 | Ivanovich et al. . | |
| 5,370,145 | 12/1994 | Wu | 135/127 |
| 5,385,165 | 1/1995 | Hazinski et al. . | |
| 5,427,381 | 6/1995 | Macaluso et al. | 273/400 |
| 5,439,017 | 8/1995 | Brown . | |
| 5,439,018 | 8/1995 | Tsai . | |
| 5,467,794 | 11/1995 | Zheng | 135/125 |
| 5,499,821 | 3/1996 | Rycroft | 273/399 X |
| 5,524,900 | 6/1996 | Allen | 273/396 |
| 5,560,385 | 10/1996 | Zheng | 135/125 |
| 5,592,961 | 1/1997 | Chin . | |
| 5,601,105 | 2/1997 | Blen et al. . | |
| 5,645,096 | 7/1997 | Hazinski et al. . | |
| 5,676,168 | 10/1997 | Price . | |
| 5,800,067 | 9/1998 | Easter . | |
| 5,816,278 | 10/1998 | Kim . | |
| 5,816,954 | 10/1998 | Zheng | 473/471 |

FOREIGN PATENT DOCUMENTS

| | | |
|---|---|---|
| 2635136 | 2/1990 | France . |

*Primary Examiner*—Jeanette Chapman
*Assistant Examiner*—Michael Chambers
*Attorney, Agent, or Firm*—Raymond Sun

[57] ABSTRACT

Collapsible structures are disclosed having a central panel, a first support panel disengageably connected to the left side of the central panel, and a second support panel disengageably connected to the right side of the central panel. Each of the central panel and support panels includes a foldable frame member having a folded and an unfolded orientation, and a fabric material substantially covering the frame member.

13 Claims, 10 Drawing Sheets

COLLAPSIBLE STRUCTURES

1. Related Cases

This is a continuation of Ser. No. 08/835,730, entitled "Collapsible Structures", filed Apr. 11, 1997, now U.S. Pat. No. 5,816,954 the entire disclosures of which are incorporated by this reference as though set forth fully herein.

BACKGROUND OF THE INVENTION

2. Field of the Invention

The present invention relates to collapsible structures, and in particular, to collapsible play structures which may be provided in a variety of shapes and sizes. The collapsible structures may be twisted and folded to reduce the overall size of the structures to facilitate convenient storage and use.

3. Description of the Prior Art

Two important considerations for all toys or play things targeted for children and adults are convenience and variety. Relating to convenience, a toy must be easily transportable so that the user can move it around the home, or even to other places outside of the home. A toy must also be easily stored since an adult or child is likely to have many other toys or objects that compete for precious storage space in the home. As for variety, a toy must offer enough variety in play so that the child or adult will be able to enjoy it for a long period of time without getting bored.

Larger toys often pose a greater problem with regards to convenience. The larger toys tend to be bulky, which makes it difficult to move them around the home, and sometimes makes it prohibitive to move them outside the house to other locations. Bulky toys also take up much storage space. For these reasons, many executive toys targeted for adults are made in small sizes.

Collapsible play structures have recently become popular with both adults and children. Examples of such structures are shown and described in U.S. Pat. Nos. 5,038,812 (Norman), 5,467,794 (Zheng) and 5,560,385 (Zheng). These structures may be twisted and folded to reduce the overall size of the structures to facilitate convenient storage and use. As such, these structures are being enjoyed by many people in many different applications.

For example, these structures have been provided in many different shapes and sizes for children's play inside and outside the house. Smaller versions of these structures have been used as infant nurseries. Even smaller versions of these structures have been used as dollhouses and action figure play houses by toddlers and children.

As another example, these structures have been made into tents or outdoor structures that can be used by adults and children for camping or other outdoor purposes. These structures have also been popular as beach cabanas.

Even animals can enjoy these structures. Some of these structures have been made into shelters that can be used by pets, both inside and outside the house.

The wide-ranging uses for these collapsible structures can be attributed to the performace, convenience and variety that these structures provide. When fully expanded, these structures are stable and can be used as a true shelter without the fear of collapse. These structures are easily twisted and folded into a compact configuration to allow the user to conveniently store the structure. The light-weight nature of the materials used to make these structures makes it convenient for them to be moved from one location to another. These structures also provide much variety in use and enjoyment. For example, a child can use a structure both indoors and outdoors for different play purposes, and can use the same structure for camping.

However, these collapsible structures have been primarily used to shelter individuals, animals, and objects, and to allow individuals or animals to crawl therethrough. Thus, there is still a need for collapsible structures that provide an increased variety of play and entertainment value, and yet are simple in construction and can be conveniently deployed, collapsed, and stored.

SUMMARY OF THE DISCLOSURE

The present invention provides collapsible structures that include arcade-styled games for the fun and entertainment of both adults and children. These collapsible structures can be easily and quickly disassembled, folded and collapsed into a compact configuration. As a result, the collapsible structures according to the present invention are convenient to assemble, to use, to move around, and to disassemble and store, thereby making them ideal for use at home, at the office as an executive toy, and at many other locations.

In order to accomplish the objects of the present invention, the collapsible structure according to the present invention has a central panel, a first support panel disengageably connected to the left side of the central panel, and a second support panel disengageably connected to the right side of the central panel. Each of the central panel and support panels includes a foldable frame member having a folded and an unfolded orientation, and a fabric material substantially covering the frame member.

In one embodiment according to the present invention, the bottom surfaces of the central panel and support panels rest on the surface when the structure is in an upright position, with the central panel disposed at right angles to and between the support panels.

In another embodiment according to the present invention, the structure further includes a first base panel, and a second base panel. Each of the base panels includes a foldable frame member having a folded and an unfolded orientation, and a fabric material substantially covering the frame member. The top sides of the base panels are hingedly connected to the bottom side of the central panel. The first support panel is disengageably connected to the left side of the first base panel and the right side of the second base panel, and the second support panel is disengageably connected to the right side of the first base panel and the left side of the second base panel. When the structure is in an upright position, the base panels are disposed at an angle with respect to each other, the bottom sides of the base panels are resting on the surface, and the central panel is disposed at right angles to and between the support panels.

The collapsible structures according to the present invention may be provided with one or more entertainment features. For example, a first basket may be connected to the central panel. In addition, a first opening may be provided in the central panel, with a first tube coupling the first basket and the first opening. A second basket may be connected to the central panel opposite to the first basket, and a second opening provided in the central panel and spaced apart from the first opening, with a second tube coupling the second basket and the second opening. Another feature may include a flotation device coupled to the base panels.

In yet another embodiment according to the present invention, the structure includes a first collection panel having a foldable frame member having a folded and an unfolded orientation, and with a fabric material substantially covering the frame member. An inner side of the first collection panel is hingedly connected to the bottom side of the central panel and the top sides of the base panels. In addition, the first support panel is disengageably connected to the left side of the first collection panel, and the second support panel is disengageably connected to the right side of the first collection panel.

In a further embodiment according to the present invention, the structure has a central panel, a base panel having a front side hingedly connected to a bottom side of the central panel, a first support panel coupled to the left side of the central panel and the left side of the base panel, and a second support panel coupled to the right side of the central panel and the right side of the base panel. Each of the central panel, the base panel and the support panels includes a foldable frame member having a folded and an unfolded orientation, and a fabric material substantially covering the frame member.

The structures in accordance with the present invention may be collapsed and stored by folding the base panels (where applicable), the collection panel(s) (where applicable), and the central panel on top of each other about the hinged connection to have the base panels and central panel overlaying each other, and then twisting and folding the base panels, collection panel(s) and central panel to form a plurality of concentric rings and layers of panels to substantially reduce the size of the panels in the folded orientation. The support panels may be stacked on top of the folded panels and twisted and collapsed together, or the support panels may be twisted and collapsed separately.

DETAILED DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

The collapsible structures according to the present invention are provided in the form of arcade-style or miniature basketball games which can be enjoyed by both children and adults. These structures can be disassembled, and then folded and collapsed into a compact configuration for convenient storage and transportation. Each of the collapsible structures according to the present invention is assembled by attaching two or more panels together. These panels can assume a variety of shapes and sizes, and are assembled to create a resulting structure having any desired shape and size.

Figure 1:
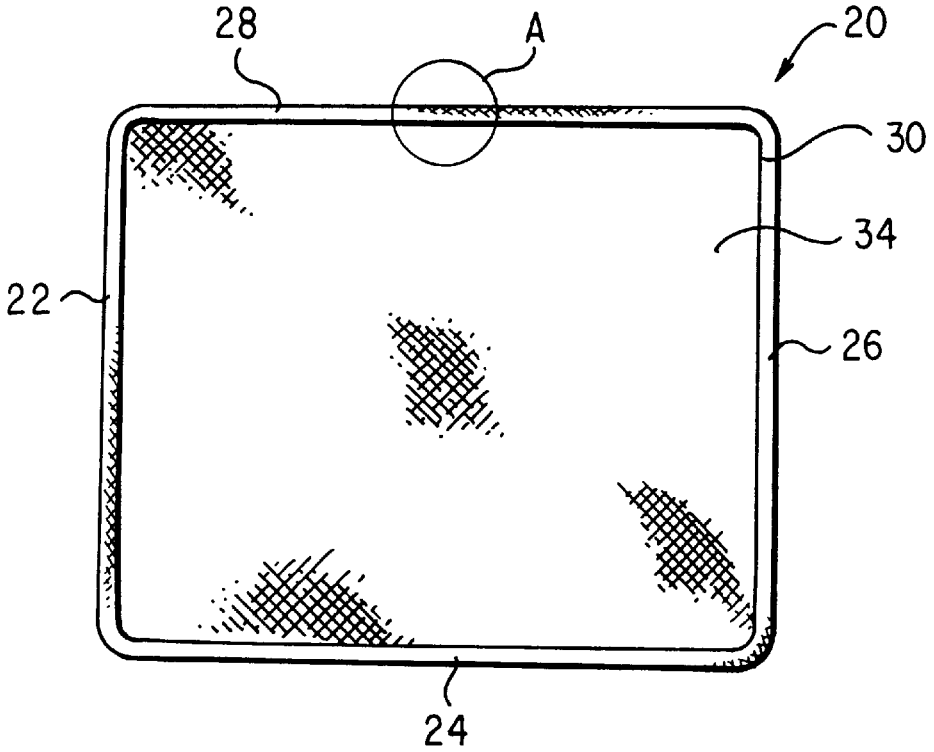
FIG. 1 is a perspective view of a panel according to a preferred embodiment of the present invention.
Figure 1A:
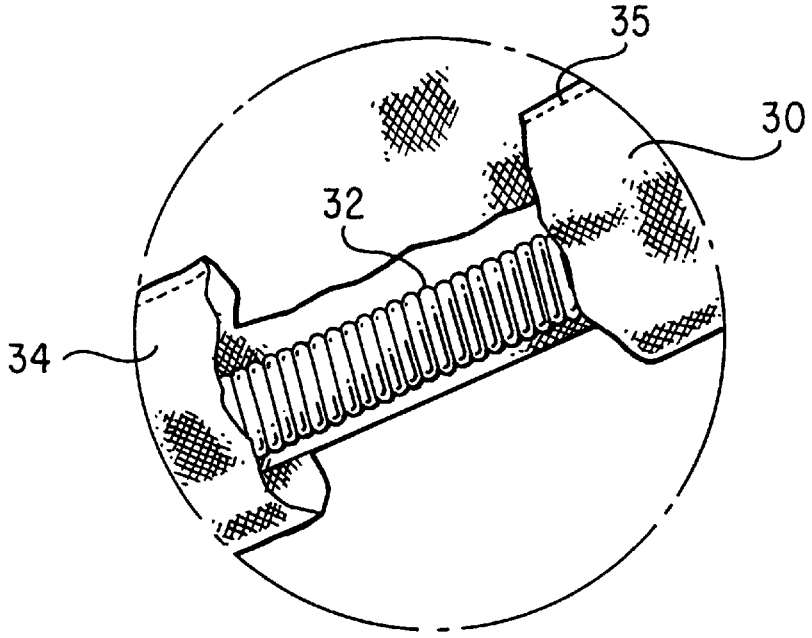
FIG. 1A is a partial cut-away view of the section A of the structure of FIG. 1 illustrating a frame member retained within a sleeve.

FIGS. 1 and 1A illustrate a panel 20 according to the present invention. The panel 20 has four sides, a left side 22, a bottom side 24, a right side 26 and a top side 28. The side panel 20 has a continuous frame retaining sleeve 30 provided along and traversing the edges of its four sides 22, 24, 26, 28. A continuous frame member 32 is retained or held within the frame retaining sleeve 30 to support the side panel 20.

The continuous frame member 32 may be provided as one closed continuous loop, or may comprise a strip of material connected at both ends to form a continuous closed loop. The continuous frame member 32 is preferably formed of flexible coilable steel, although other materials such as plastics may also be used. The frame member 32 should be made of a material which is relatively strong and yet is flexible to a sufficient degree to allow it to be coiled. Thus, the frame member 32 is capable of assuming two positions or orientations, an open or expanded position such as shown in FIG. 1, or a folded position in which the frame member 32 is collapsed into a size which is much smaller than its open position (see FIG. 3D).

Fabric or sheet material 34 extends across the side panel 20 and is held taut by the frame member 32 when in its open position. The term fabric is to be given its broadest meaning and should be made from strong, lightweight materials and may include woven fabrics, sheet fabrics, a meshed material or even films. The fabric should be water-resistant and durable to withstand the wear and tear associated with rough treatment by children. The frame member 32 may be merely retained within the frame retaining sleeve 30 without being connected thereto. Alternatively, the frame retaining sleeve 30 may be mechanically fastened, stitched, fused, or glued to the frame member 32 to retain it in position.

The frame retaining sleeve 30 may be formed by folding over the corresponding fabric piece 34 and applying a stitching 35 (see FIG. 1A).

Figure 2:
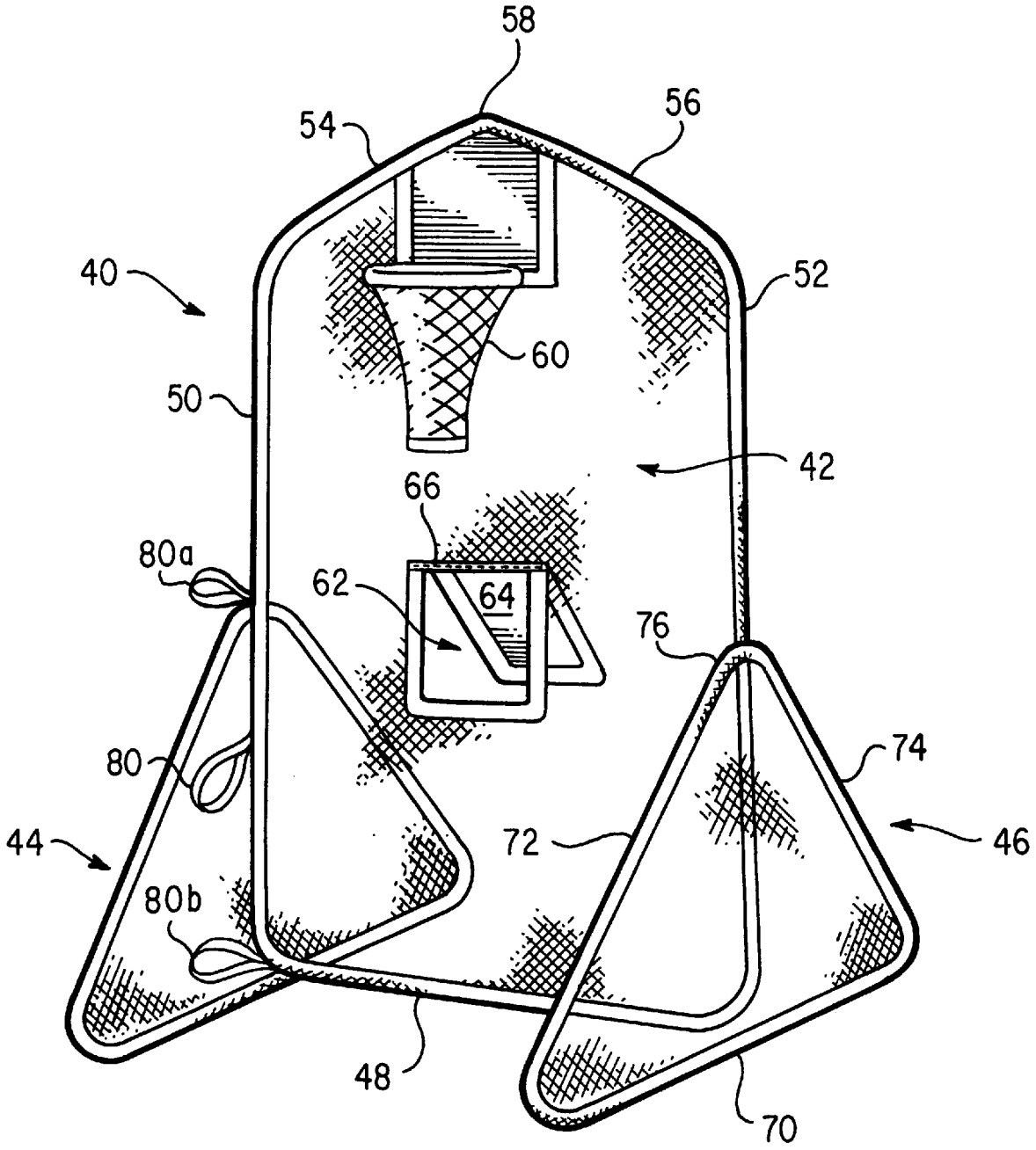
FIG. 2 is a perspective view of a collapsible structure according to a first preferred embodiment of the present invention.
Figure 2B:
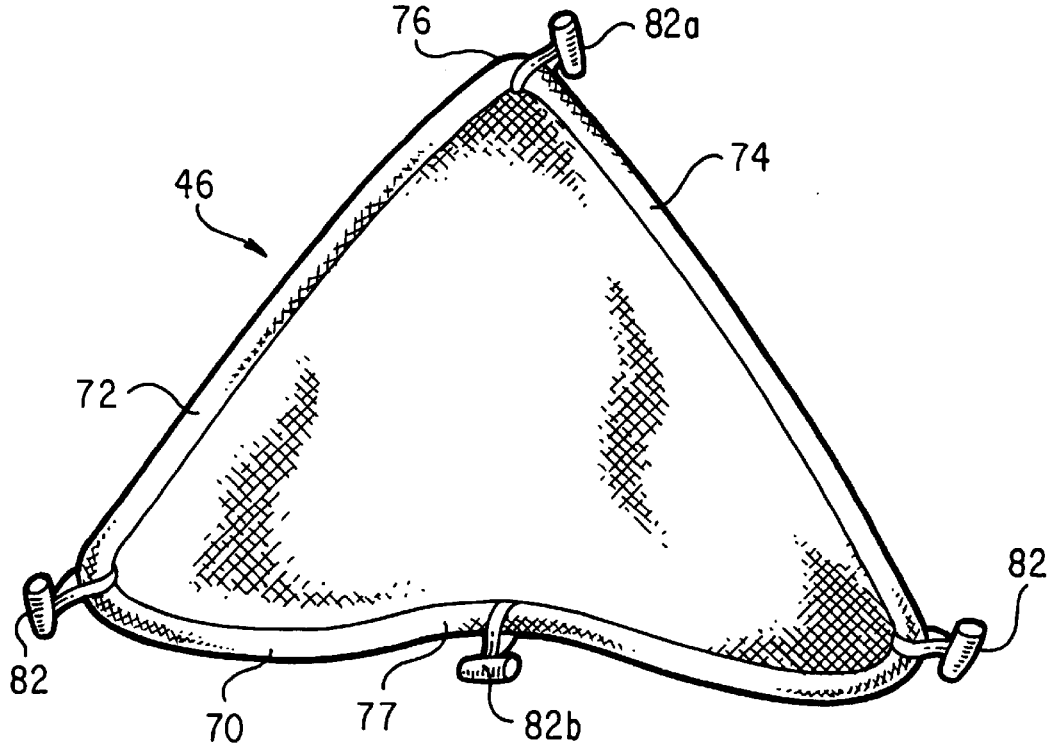
FIG. 2A is a front plan view of a support panel of the collapsible structure of FIG. 2.

FIG. 2 illustrates a first embodiment of a collapsible structure according to the present invention. The structure 40 has a central panel 42 and two support panels 44 and 46. The central panel 42 is substantially rectangular in configuration, having a bottom side 48, a left side 50 and a right side 52 extending from opposite ends of the bottom side 48, a left angled upper side 54 extending from the top of the left side 50, and a right angled upper side 56 extending from the top of the right side 52 and connecting the left angled upper side 54 at an apex 58. A basket 60 is provided on one side of the central panel 42 adjacent but offset from the apex 58. An opening 62 is cut at about the central portion of the panel 42, with a flap 64 hingedly connected along an upper edge, such as by stitching 66, to an upper edge of the opening 62 to cover the opening 62. Alternatively, the flap 64 can be provided by cutting its three edges from the fabric of the panel 42, while leaving the upper edge attached to the fabric to act as a hinge for the flap 64.

Referring also to FIG. 2A, support panels 44 and 46 may be identical in size and shape, and include a bottom side 70, a left diagonal side 72 and a right diagonal side 74 extending from opposite ends of the bottom side 70 and connecting at an apex 76. Support panels 44 and 46 are disengageably connected to the left and right sides 50 and 52, respectively, of the central panel 42 to hold and support the central panel 42 in a vertical, upright position during use. Each support panel 44, 46 is disengageably connected to the left and right sides 50, 52, respectively, at two spaced-apart locations on the support panel 44, 46, such as at the apex 76 and at a central portion 77 of the bottom side 70.

The disengageable connection of the support panels 44, 46 to central panel 42 can be accomplished in a number of ways. In a first disengageable connection method according to the present invention, a plurality of loops 80 are stitched or otherwise provided along the left and right sides 50 and 52, and a plurality of toggles 82 are provided along the fabric, sides and/or apices of the support panels 44, 46. The connection is achieved by slipping selected toggles 82 through selected loops 80. For example, toggles 82*a* and 82*b* are connected to loops 80*a* and 80*b*, respectively. As an alternative, tie members in the form of a strap or a strip of fabric can be provided on all the panels 42, 44 and 46 and the opposing tie members are tied together at selected locations to connect the panels. Those skilled in the art will appreciate that other disengageable connection methods, such as but not limited to opposing Velcro pads, hooks, snaps and detachable zippers, can be used without departing from the spirit and scope of the present invention, as long as these connection methods provide a stable support for the resulting structure.

Figure 3B:
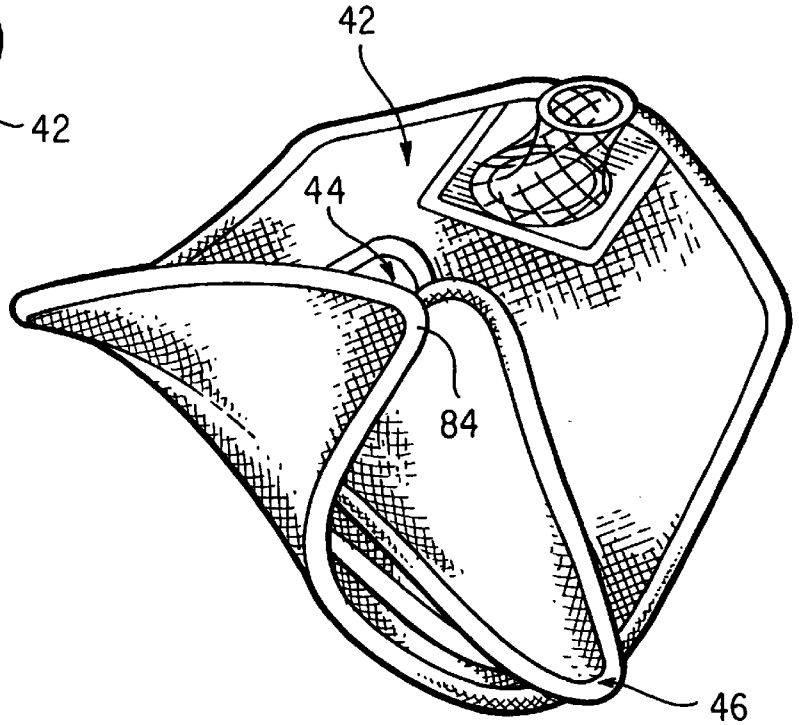
FIGS. 3A–3D illustrate how a stack of the panels of the collapsible structure of FIG. 2 may be twisted and folded for compact storage.
Figure 3A:
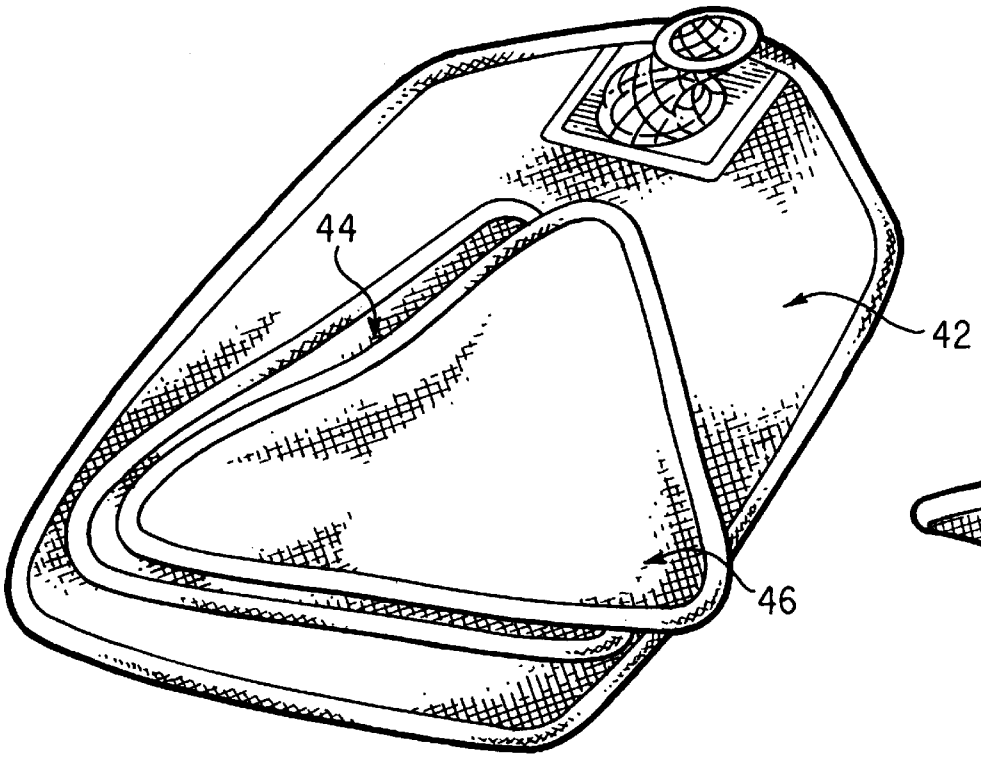
Figure 3C:
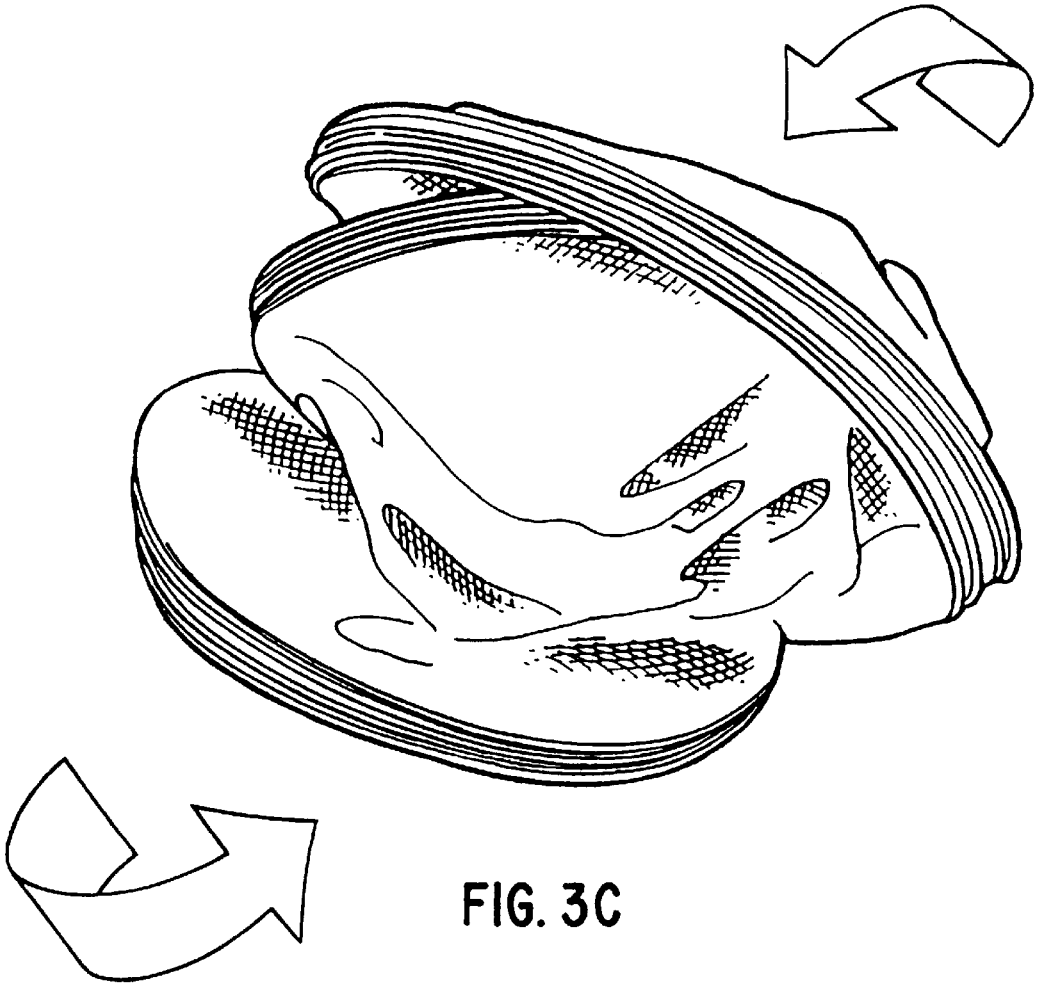
Figure 3D:
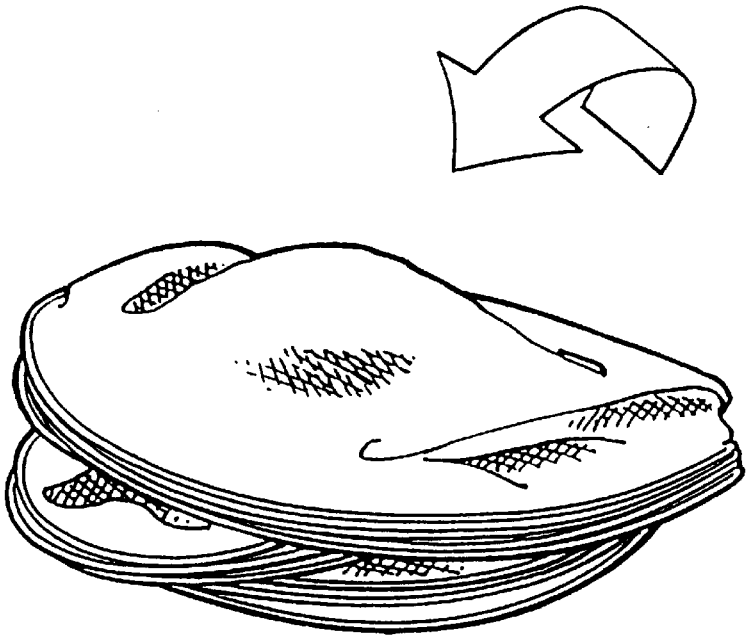

The structure 40 may be disassembled from the configuration shown in FIG. 2 by removing the disengageable connections between the central panel 42 and the support panels 44, 46. The three panels 42, 44 and 46 are then placed one on top of the other to form a stack of panels, as shown in FIG. 3A. The stack of panels is then twisted and folded to collapse the frame members and panels into a smaller shape. In the next step shown in FIG. 3B, the opposite border 84 of the largest panel (i.e., panel 42) is folded in upon the previous fold to further collapse the frame members with the panels. As shown in FIG. 3C, the next step is to continue the collapsing so that the initial size of the structure is reduced. FIG. 3D shows the frame members and panels collapsed on each other to provide for a small essentially compact configuration having a plurality of concentric frame members and layers of the panels so that the collapsed structure has a size which is a fraction of the size of the initial structure. In this manner, the three separate panels 42, 44 and 46 can be folded, collapsed and stored together. Alternatively, the user may fold and collapse each panel 42, 44 and 46 separately according to the steps illustrated in FIGS. 3A–3D, and store these panels separately.

To assemble the structure 40 for use, the user opens the panels 42, 44, and 46, and the springy and biased nature of the frame members inside the panels 42, 44 and 46 will cause the panels 42, 44 and 46 to spring open and assume the open or expanded position. The three separate panels 42, 44 and 46 are then connected to form the desired configuration, in which the support panels 44, 46 are disposed generally at right angles to the central panel 42. When in use, the user may toss a ball into the basket 60, or may attempt to throw a ball through the flap 64 and opening 62 to the other side of the central panel 42.

Figure 4:
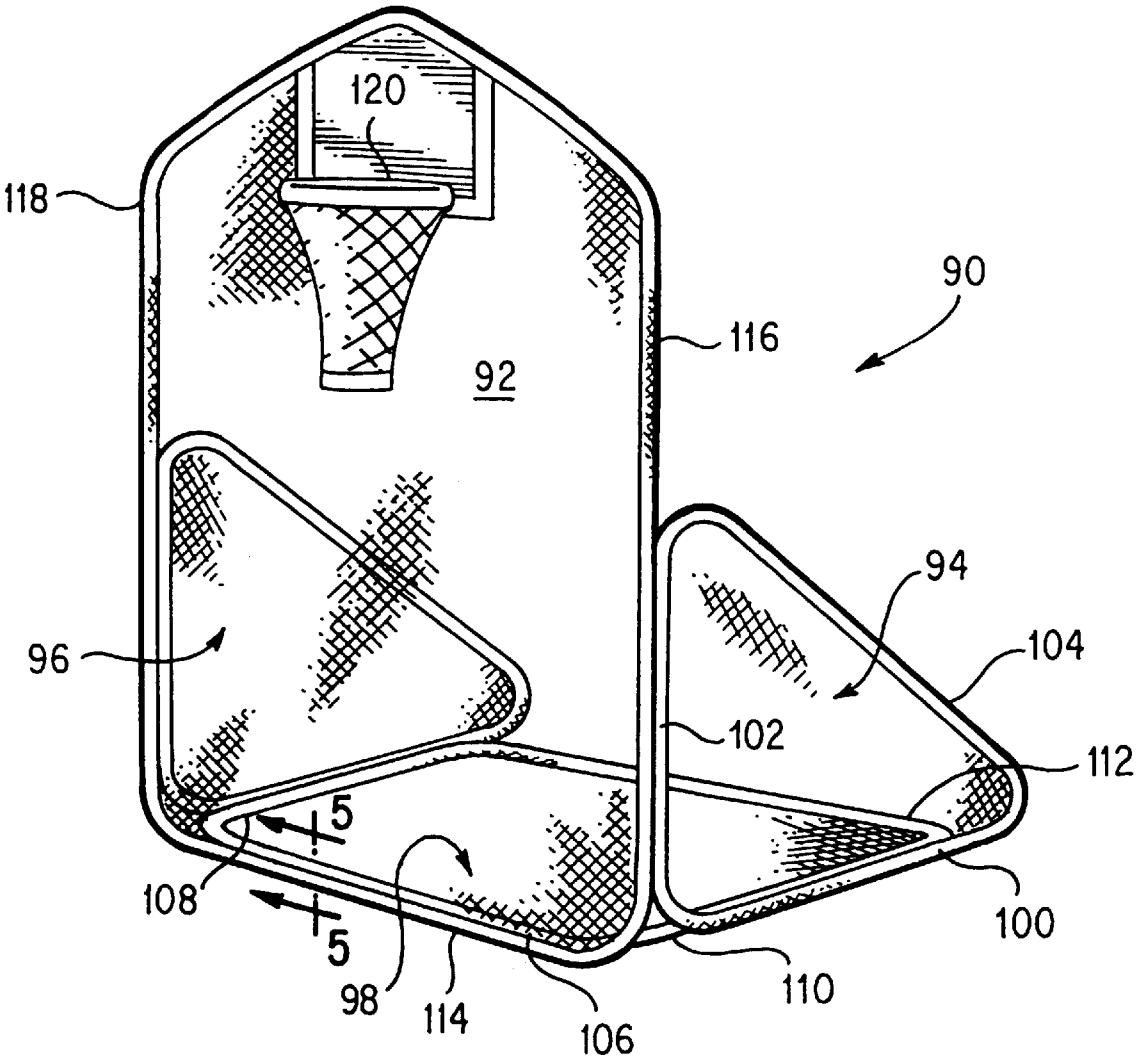
FIG. 4 is a perspective view of a collapsible structure according to a second preferred embodiment of the present invention.

FIG. 4 illustrates a second embodiment of a collapsible structure according to the present invention. The structure 90 has a central panel 92, two support panels 94 and 96, and a base panel 98. The central panel 92 has a configuration which is generally the same as central panel 42 described above. Support panels 94 and 96 may be identical in size and shape, and include a bottom side 100, a vertical side 102 extending from one end of the bottom side 100, and a diagonal side 104 connecting the other end of the bottom side 100 and the upper end of the vertical side 102. The base panel 98 has a front side 106, a left side 108 and a right side 110 extending rearwardly from opposite ends of the front side 106, and a rear side 112 connecting the rear ends of the left side 108 and right side 110.

The sides of the panels 92, 94, 96 and 98 are hingedly connected so that these hinged connections cannot be disengaged without destroying the connection. Examples of the structures for these hinged connections are described below. The bottom side 114 of central panel 92 is hingedly connected to the front side 106 of the base panel 98. The vertical side 102 of support panel 94 is hingedly connected to the right side 116 of central panel 92, and the vertical side 102 of support panel 96 is hingedly connected to the left side 118 of central panel 92. To assemble the structure 90, the base panel 98 is placed on a surface, and the central panel 92 and support panels 94, 96 are raised to the positions shown in FIG. 4. The bottom sides 100 of the support panels 94 and 96 are then connected to the right side 110 and the left side 108, respectively, of base panel 98 by the disengageable connection methods and mechanisms described above. In the assembled position shown in FIG. 4, the support panels 94, 96 hold and support the central panel 92 in a vertical, upright position during use. Weights (not shown) may optionally be placed on or attached to specific locations on the base panel 98 to provide more stability to the structure 90. A basket 120 may be provided on either side of the central panel 92 for receiving a ball tossed thereat.

Figure 5A:
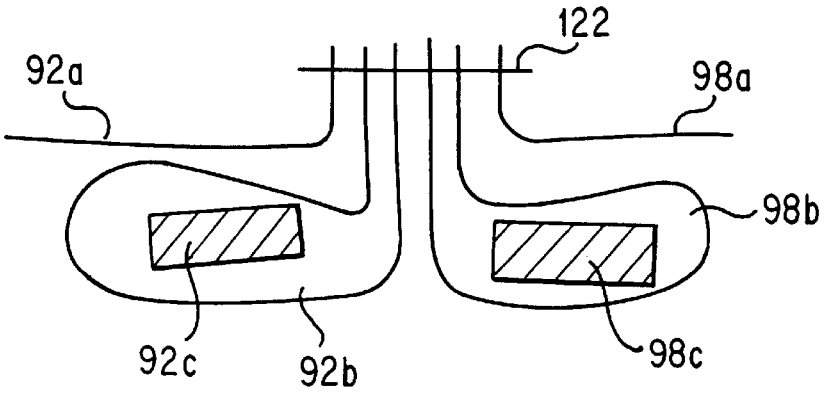
FIG. 5A is a cross-sectional view of a first preferred connection between two adjacent panels of the structure of FIG. 4 taken along line 5—5 thereof.

FIG. 5A illustrates a first method for hingedly connecting adjacent sides 106 and 114 of the panels 98 and 92, respectively. The fabric pieces 92*a* and 98*a* are stitched at their edges by a stitching 122 to the respective sleeves 92*b* and 98*b*, respectively. Each sleeve 92*b* and 98*b* may be formed by folding a piece of fabric. The stitching 122 also acts as a hinge for the panels 92 and 98 to be folded upon each other, as explained below. The hinged connections for the other pairs of adjacent sides may be identical.

Figure 5B:
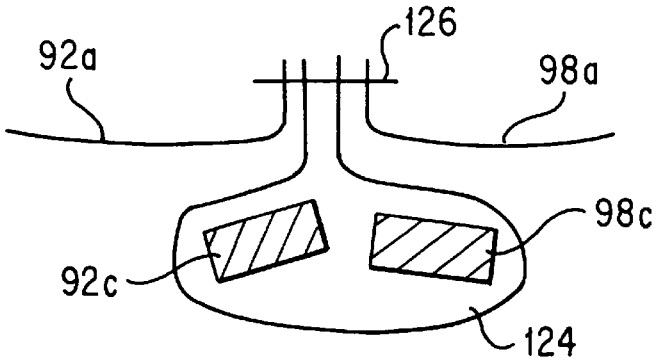
FIG. 5B is a cross-sectional view of a second preferred connection between two adjacent panels of the structure of FIG. 4 taken along line 5—5 thereof.

FIG. 5B illustrates a second method for hingedly connecting adjacent sides 106 and 114 of the panels 98 and 92, respectively. As in the connection of FIG. 5A, the fabric pieces 92*a* and 98*a* are folded over at their edges along all the sides (except for sides 114 and 106) to define the respective sleeves 92*b* and 98*b*, respectively. However, the frame retaining sleeves 92*b* and 98*b* converge at, or are connected to, one sleeve portion which interconnects panels 92 and 98 to form a singular frame retaining sleeve 124 along sides 114 and 106 which retains the frame members 92*c* and 98*c*. Sleeve 124 may be formed by providing a tubular fabric, or by folding a piece of fabric, and applying a stitching 126 to its edges to connect the sleeve 124 to the fabric pieces 92*a* and 98*a*. Stitching 126 acts as a hinge for the panels 92 and 98. The connections for the other pairs of adjacent sides may be identical.

Structure 90 may be disassembled, folded and collapsed for storage according to the following method. The disengageable connections between the bottom sides 100 of the support panels 94 and 96 and the right side 110 and the left side 108, respectively, of the base panel 98 are first disengaged and the central panel 92 laid on the surface. The base panel 98 is then folded about the hinged connection between its front side 106 and the bottom side 114 of the central panel 92 so that base panel 98 rests on the central panel 92. The support panels 94 and 96 are then folded about the hinged connection between their vertical side 102 and the right side 116 and left side 118, respectively, of the central panel 92 so that the support panels 94, 96 rest on the base panel 98 and central panel 92. This resulting stack of panels 92, 98, 94 and 96 may then be folded and collapsed in the manner described in FIGS. 3A–3D.

To assemble the structure 90 for use, the user opens the panels 92, 94, 96 and 98, and the springy and biased nature of the frame members inside the panels 92, 94, 96 and 98 will cause the panels 92, 94, 96 and 98 to spring open and assume their open or expanded position. The disengageable connections are then formed to provide the structure 90 in the configuration shown in FIG. 4, in which the support panels 94, 96 are positioned generally at right angles to the base panel 98 and the central panel 92, and in which the base panel 98 and the central panel 92 are disposed at approximate right angles to each other.

Alternatively, the bottom sides 100 of the support panels 94 and 96 may be hingedly connected to the right side 110 and the left side 108, respectively, of base panel 98, with the vertical sides 102 of the support panels 94 and 96 disengageably connected to the right side 116 and the left side 118, respectively, of central panel 92. To disassemble, fold and collapse this structure 90, the disengageable connections are first disengaged, and the panels 94, 96 and 92 are then folded onto the base panel 98, in this order, for example, to produce a stack of panels 98, 94, 96 and 92 which is folded and collapsed in the manner described in FIGS. 3A–3D.

As a further alternative, the two support panels 94, 96 can be provided separately from the base panel 98 and the central panel 92, with their vertical sides 102 and bottom sides 100 disengageably connected to the central panel 92 and the base panel 98, respectively. To disassemble, fold and collapse this structure 90, the disengageable connections are first disengaged, and the base panel 98 folded onto the central panel 92, and the separate support panels 94, 96 placed on top of the stacked central and base panels 92, 98, to produce a stack of panels 92, 98, 94 and 96 which is folded and collapsed in the manner described in FIGS. 3A–3D.

As yet another alternative, all the panels 92, 94, 96 and 98 can be provided separately and then disengageably connected to each other to form the structure 90. To disassemble, fold and collapse this structure 90, the disengageable connections are first disengaged, and panels stacked one on top of the other to produce a stack of panels which is folded and collapsed in the manner described in FIGS. 3A–3D.

Figure 6:
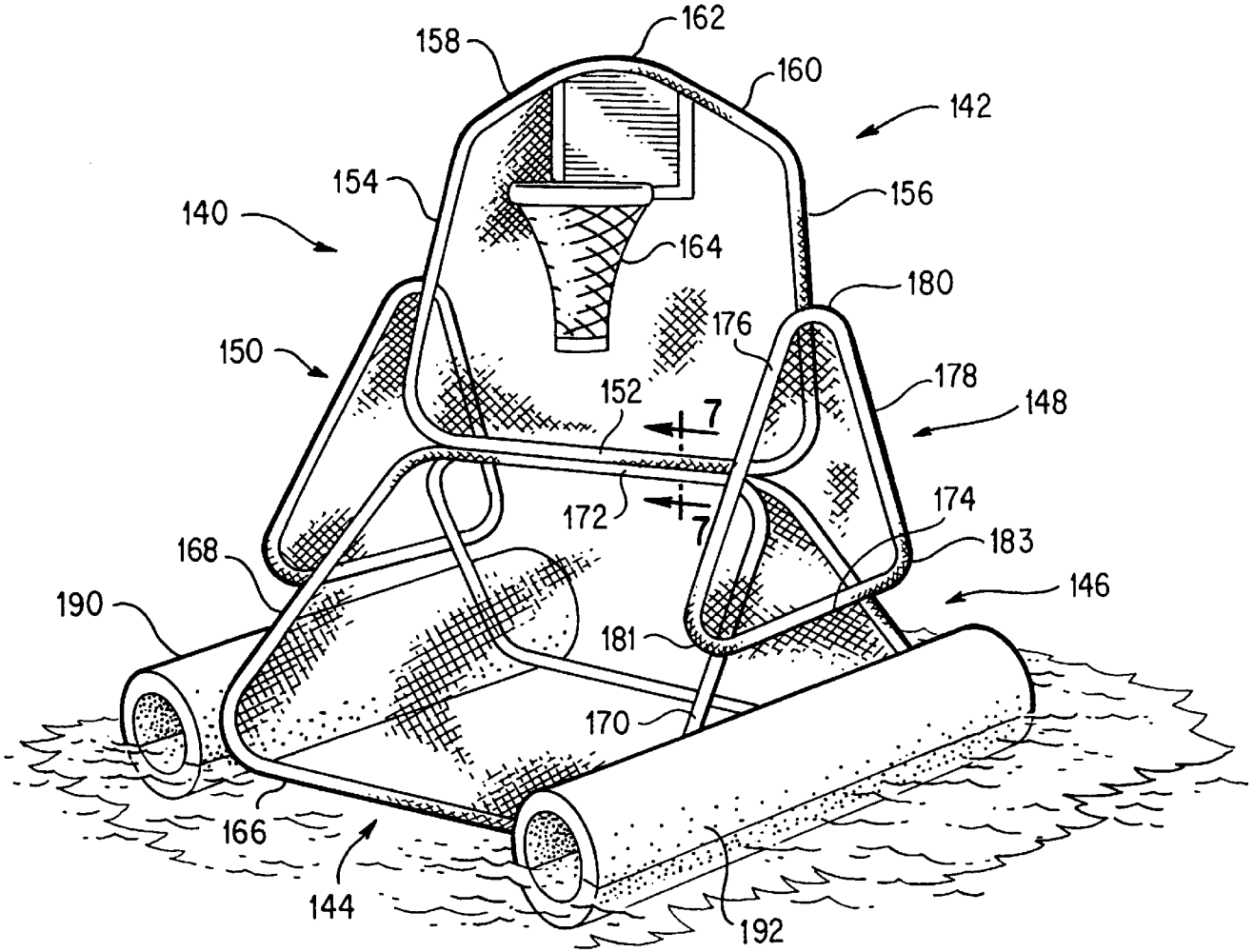
FIG. 6 is a perspective view of a collapsible structure according to a third preferred embodiment of the present invention.

FIG. 6 illustrates a third embodiment of a collapsible structure according to the present invention. The structure 140 has a central panel 142, a first base panel 144, a second base panel 146, and two support panels 148 and 150. The central panel 142 is substantially rectangular in configuration, having a bottom side 152, a left side 154 and a right side 156 extending from opposite ends of the bottom side 152, a left angled upper side 158 extending from the top of the left side 154, and a right angled upper side 160 extending from the top of the right side 156 and connecting the left angled upper side 158 at an apex 162. A basket 164 is provided on one side of the central panel 142 adjacent to but offset from the apex 162.

The first base panel 144 has a bottom side 166, a left side 168 and a right side 170 extending from opposite ends of the bottom side 166, and a top side 172 connecting the upper ends of the left side 168 and the right side 170. The second base panel 146 is preferably identical in shape and size to the first base panel 144.

Support panels 148 and 150 may be identical in size and shape, and include a bottom side 174, a left diagonal side 176 and a right diagonal side 178 extending from opposite ends of the bottom side 174 and connecting at a top apex 180. Support panels 150 and 148 are disengageably connected to the left and right sides, respectively, of the central panel 142 and the base panels 144, 146 to hold and support the central panel 142 in a vertical, upright position during use.

Figure 7A:
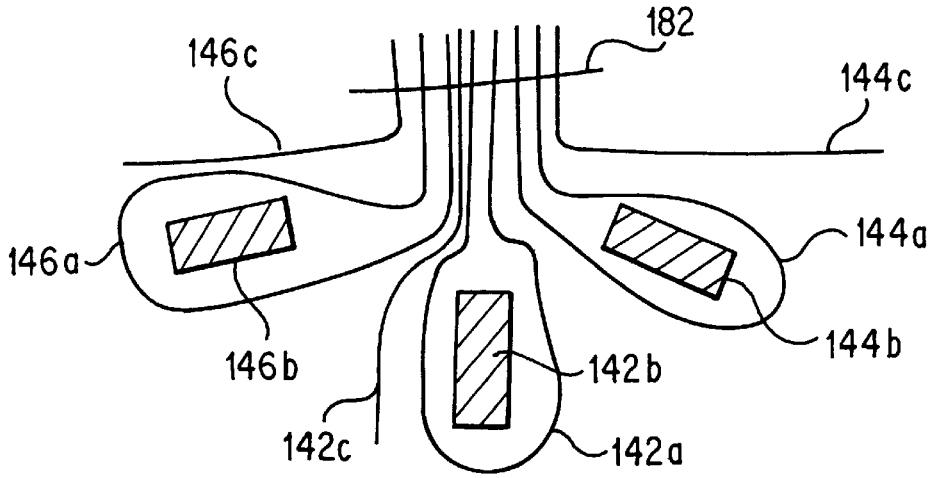
FIG. 7A is a cross-sectional view of a first preferred connection between the three adjacent panels of the structure of FIG. 6 taken along line 7—7 thereof.
Figure 7B:
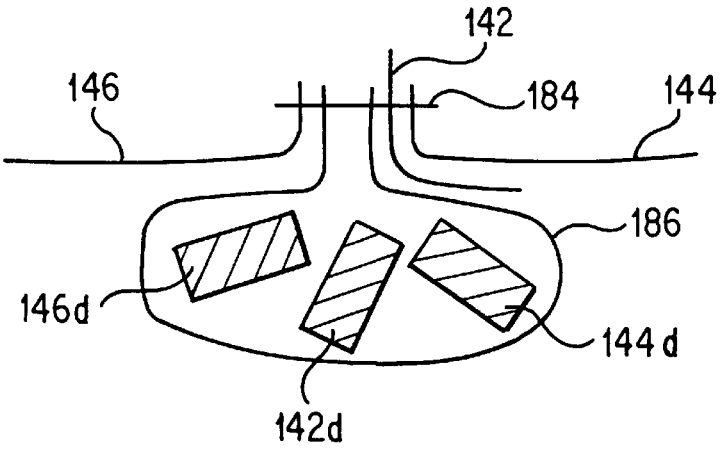
FIG. 7B is a cross-sectional view of a second preferred connection between the three adjacent panels of the structure of FIG. 6 taken along line 7—7 thereof.

The bottom side 152 of the central panel 142 and the top sides 172 of the base panels 144 and 146 are hingedly connected to each other according to one of the following methods. FIG. 7A illustrates a first hinged connection along line 7—7 of FIG. 6, in which three frame retaining sleeves 142*a*, 144*a* and 146*a* each retain a frame member 142*b*, 144*b* and 146*b*, respectively, and are held together by stitching 182. The fabric pieces 142*c*, 144*c*, 146*c* of panels 142, 144 and 146, respectively, are also stitched to the sleeves 142*a*, 144*a* and 146*a* by the stitching 182. Alternatively, FIG. 7B illustrates a second hinged connection in which the three frame retaining sleeves 142*a*, 144*a* and 146*a* are each formed by a separate stitching along all sides except along sides 152 and 172. The sleeves 142*a*, 144*a* and 146*a* converge to form, or are connected to, one singular frame retaining sleeve 186 which retains the frame members 142*d*, 144*d* and 146*d*. The singular frame retaining sleeve 186 is created by folding a fabric material and applying a stitching 184 to hold the sleeve 186 together with the panels 142, 144 and 146. The stitching 186 acts as a hinge for the panels 142, 144 and 146.

To set up the structure 140 for use, the combined central panel 142 and base panels 144, 146 are separated from the support panels 148, 150, and all the panels 142, 144, 146, 148 and 150 are opened to their opened or expanded configurations in the manner described above. Base panels 144 and 146 are spread apart at an angle so that they form an inverted "V" shape, with their bottom sides 166 resting on the surface to support the central panel 142 along their top sides 172. Support panels 148 and 150 are disengageably connected to the right and left sides, respectively, of the central panels 142 and base panels 144, 146, to provide support to the base panels 144, 146 and the central panel 142. For example, the support panel 148 is disengageably connected at about its first bottom apex 181 to the right side 170 of the first base panel 144 and at about its second bottom apex 183 to the left side 168 of the second base panel 146, and the support panel 150 is disengageably connected at about its first bottom apex 181 to the right side 170 of the second base panel 146 and at about its second bottom apex 183 to the left side 168 of the first base panel 144, to retain and support the base panels 144, 146 at a determined position with respect to each other. In addition, the support panels 148 and 150 are disengageably connected at their top apices 180 to the right side 156 and the left side 154, respectively, of the central panel 142, to retain and support the central panel 142 at a determined vertical and upright position with respect to the base panels 144, 146. Support panels 148 and 150 are disposed at right angles to the base panels 144, 146 and the central panel 142.

Structure 140 may be disassembled, folded and collapsed for storage according to the following method. The disengageable connections between the support panels 148, 150 and the central panel 142 and base panels 144, 146 are first disengaged and the support panels 148, 150 separated from the other panels. The central panel 142 and base panels 144, 146 are then folded onto each other to form a stack of three panels. The support panels 148, 150 are then placed on top of the stack of three panels to form a stack of five panels, which is then folded and collapsed in the manner described in FIGS. 3A–3D.

When in use, a ball tossed through the basket 164 will land on the first base panel 144 and roll down the base panel 144. In addition, flotation devices 190 and 192 may be attached by using tie members, straps, toggles and loops, hooks, or other conventional mechanisms to the left and right sides of the base panels 144, 146 to allow the structure 140 to be used in a swimming pool or at the beach. The flotation devices 190, 192 can be a roll of foam, or an inflation tube, and those skilled in the art will appreciate that any material or configuration can be provided for the flotation devices 190, 192 without departing from the spirit and scope of the present invention.

Figure 9:
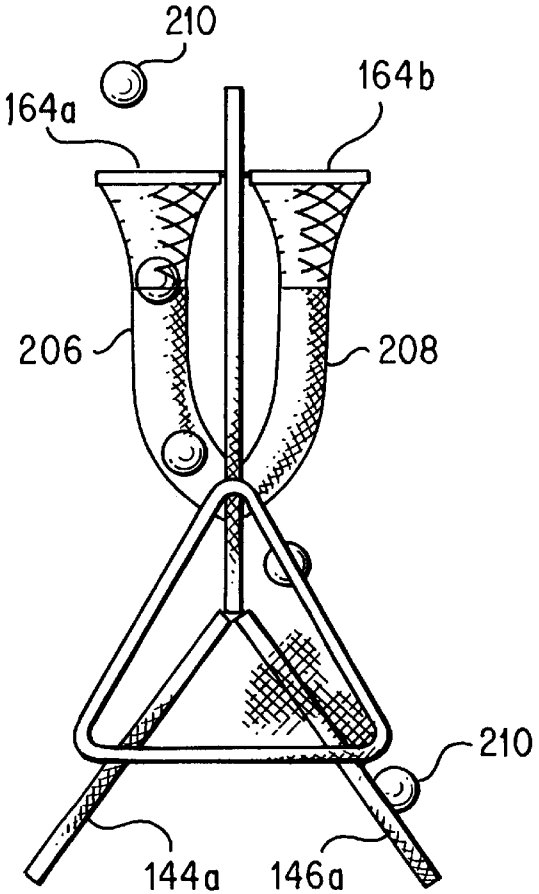
FIG. 9 is a side plan view of the collapsible structure of FIG. 8.
Figure 8:
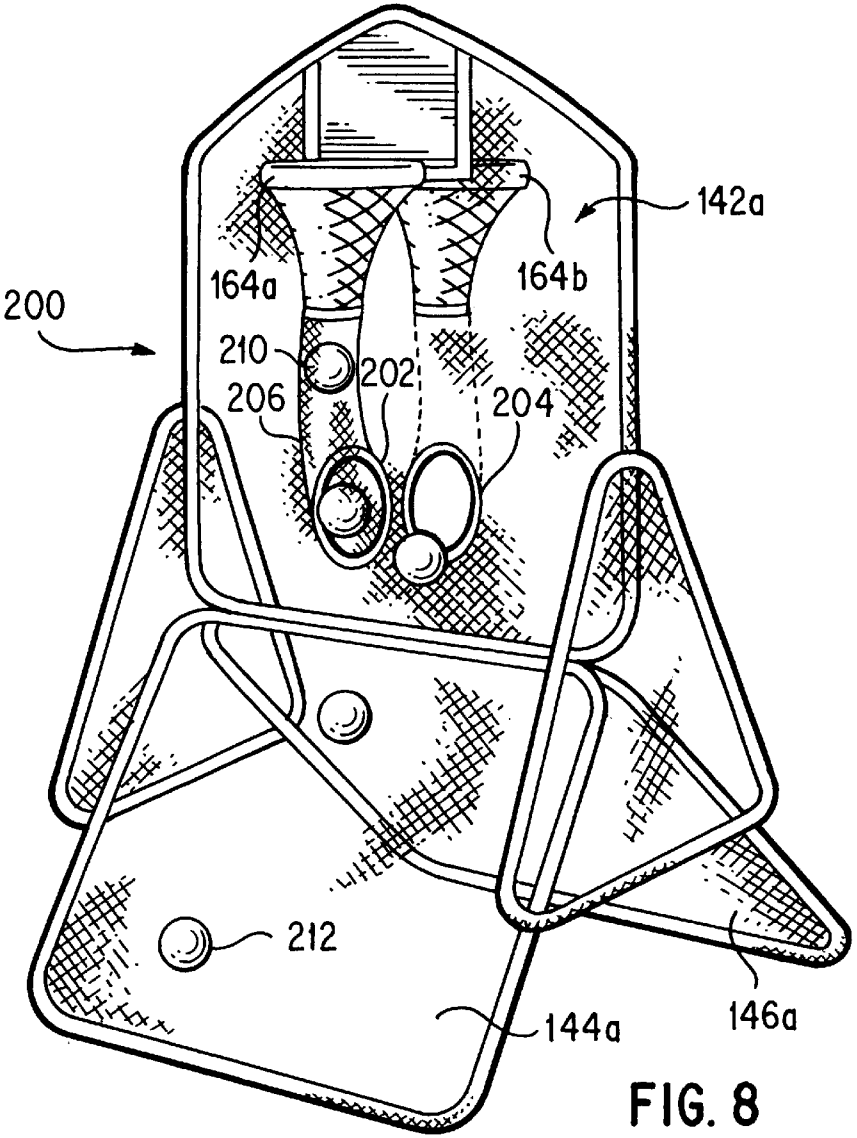
FIG. 8 is a perspective view of a collapsible structure according to a fourth preferred embodiment of the present invention.

FIGS. 8 and 9 illustrate a fourth embodiment of a collapsible structure according to the present invention. The structure 200 is essentially the same as structure 140, except that central panel 142*a* is provided with baskets 164*a*, 164*b* on opposing surfaces of its fabric, and first and second openings 202 and 204 are provided in side-by-side manner in the central panel 142*a* below the baskets 164*a* and 164*b*. A first tube 206 has its opposing ends stitched or otherwise connected to the basket 164*a* and the first opening 202, and a second tube 208 has its opposing ends stitched or otherwise connected to the basket 164*b* and the second opening 204. Alternatively, the ends of the tubes 206 and 208 may be removably attached to the baskets 164*a*, 164*b* and the openings 202, 204 by a removable connection mechanism, such as but not limited to opposing Velcro pads, toggles, hooks, ties or similar mechanisms. The tubes 206 and 208 can be made from a non-transparent fabric material, or from a mesh or transparent material that allows the interior of the tube to be viewed. The material is also preferably a flexible material which allows the tubes 206, 208 to be folded and collapsed along with the panels of the structure 200.

Thus, when the structure 200 is in use, balls 210 entering basket 164*a* will be guided by the first tube 206 and pass through first opening 202 and roll down the second base panel 146*a*. Similarly, balls 212 entering basket 164*b* will be guided by the second tube 208 and pass through second opening 204 and roll down the first base panel 144*a*. To change the variety of play, one or both tubes 206 and 208 can be removed completely so that balls entering the baskets 164*a*, 164*b* will be roll down first and second base panels 144*a*, 146*a*, respectively. As a further alternative, the tubes 206 and 208 can be removably connected at openings 204, 202, respectively.

Figure 11:
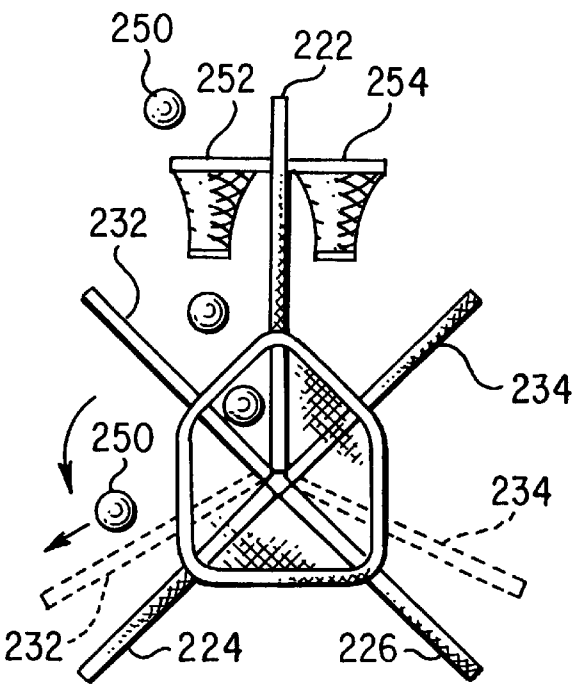
FIG. 11 is a side plan view of the collapsible structure of FIG. 10.
Figure 10:
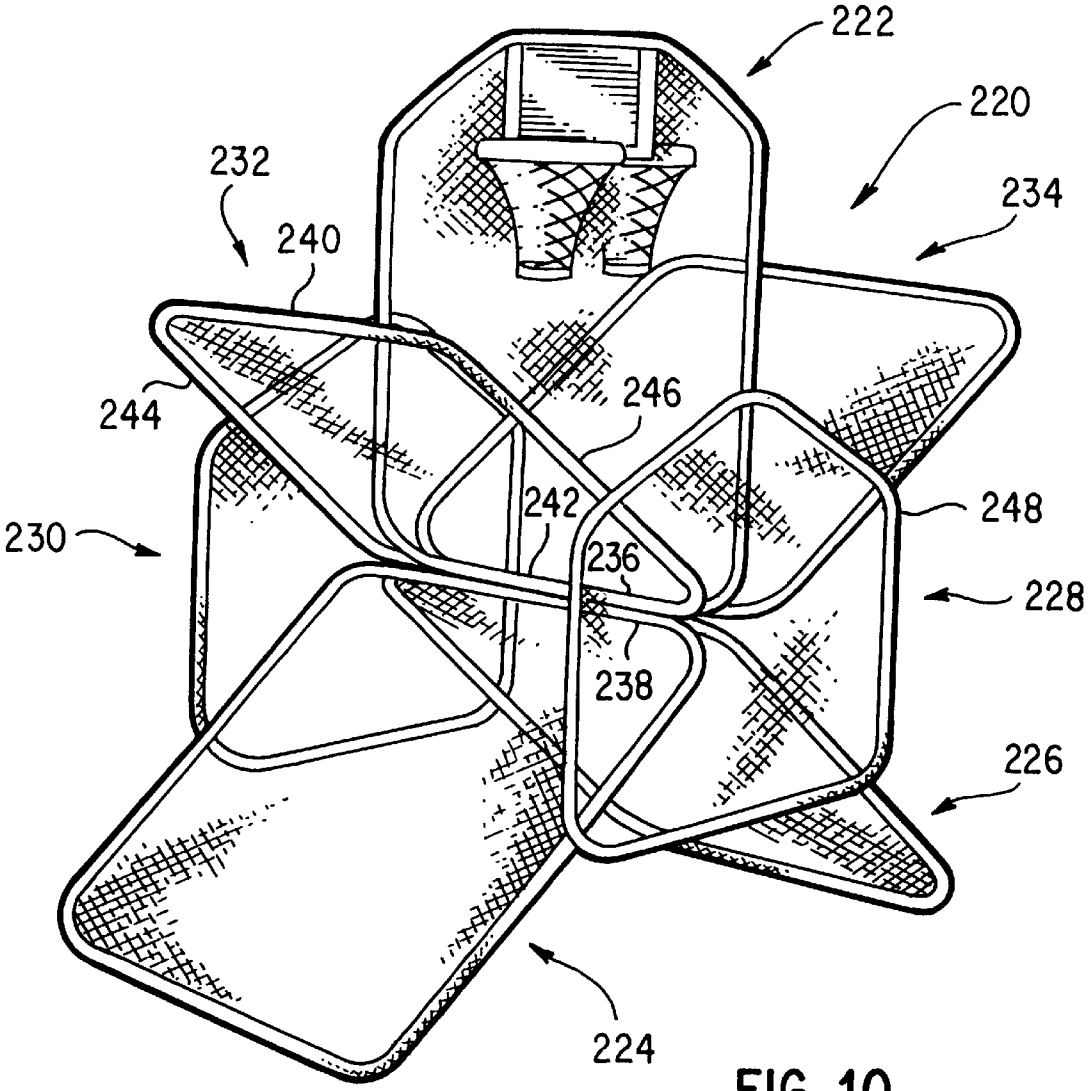
FIG. 10 is a perspective view of a collapsible structure according to a fifth preferred embodiment of the present invention.

FIGS. 10 and 11 illustrate a fifth embodiment of a collapsible structure according to the present invention. The structure 220 is essentially the same as structure 140, in that it has a central panel 222 supported below by two base panels 224 and 226 that are angled with respect to each other, and with the sides of the central panel 222 and the base panels 224, 226 supportably connected by two disengageable support panels 228 and 230. There are two differences between structure 220 and structure 140. First, the support panels 228 and 230 have a five-sided configuration similar to the configuration of the central panels 142 and 222, rather than the generally triangular configuration of the support panels 148 and 150. Second, and more significantly, two collection panels 232 and 234 are hingedly connected to the hinged connection between the bottom side 236 of the central panel 222 and the top sides 238 of the base panels 224 and 226. Each collection panel 232, 234 has a generally square or rectangular configuration, with an outer side 240 and an inner side 242 connected at their ends by a left side 244 and a right side 246.

The inner sides 242 of the collection panels 232, 234 are hingedly connected to the bottom side 236 of the central panel 222 and the top sides 238 of the base panels 224 and 226 to form a five-sided hinged connection according to the general principles for the hinged connections described and illustrated above for the two- and three-sided hinged connections in FIGS. 5A, 5B, 7A and 7B. In particular, the frame members of each of the five panels 222, 224, 226, 232 and 234 can be retained in separate frame retaining sleeves, and the five separate frame retaining sleeves and fabric pieces stitched together by a stitching, according to the principles illustrated in FIGS. 5A and 7A. Alternatively, the frame members of each of the five panels 222, 224, 226, 232 and 234 can be retained in separate frame retaining sleeves, with each sleeve converging to a single retaining sleeve which holds and retains the portions of the five frame members along the hinged connection of the five sides, according to the principles illustrated in FIGS. 5B and 7B.

The left side 244 and the right side 246 of each collection panel 232, 234 are disengageably connected to the support panels 230, 228, respectively, at a location of the support panels 230, 228 that will hold the collection panels 232, 234 at an upwardly angled position, as shown in FIGS. 10 and 11. This location can be anywhere along the sides of the support panels 230, 228, such as, but not limited to, adjacent a corner 248 of the support panels 230, 228, and this location can be adjusted to provide the collection panels 232, 234 at different angles. The collection panels 232, 234 are provided to collect balls 250 deposited through the baskets 252, 254 positioned on opposing surfaces of the central panel 222. To retrieve the balls collected on the collection panels 232, 234, the user merely removes the disengageable connections between the collection panels 232, 234 and the support panels 228, 230, and allows the collection panels 232, 234 to be lowered towards the base panels 224, 226, respectively, to allow the balls 250 to roll down the collection panels 232, 234 (as shown in phantom in FIG. 11). The collection panels 232, 234 are then connected again to the support panels 228, 230 to assume the angled position shown in FIG. 10.

Assembly and disassembly of the structure 220 is accomplished by using the same general methods described above for structure 140, except that the stack of panels to be collapsed now includes seven panels instead of five panels. Since the panels 222, 224, 226, 232 and 234 are hingedly connected to each other, they will form a stack of five panels that can be folded one on top of the other, and the two separate support panels 228, 230 can be added to this stack of five panels to be collapsed into a smaller configuration for storage and transportation.

It will be appreciated by those skilled in the art that any of the features shown in any of the embodiments of the present invention can be applied to any of the other embodiments. For example, the openings 62, 202, 204 can be provided in any of the central panels 92, 142, 142*a* or 222. Similarly, baskets can be provided on either or both surfaces of the central panels 92, 142, 142*a* or 222. The sizes of the openings, and of the top opening of the baskets, as well as the size of the balls, can be adjusted to change the degree of difficulty. In addition, although the openings 202, 204 are illustrated as being generally circular, and opening 62 as being generally square, these openings can also be provided in any desired shape or size. The fabric pieces on any of the panels can be decorated with any pattern, color or design to provide an attractive structure. In addition, the panels that are provided separately (i.e., not hingedly connected) can be stacked together with the stack of hingedly-connected panels to be folded and collapsed together, or can be folded and collapsed separately from each other. Further, the corners that connect the sides of the panels illustrated in the present invention are preferably rounded, although those skilled in the art will appreciate that these corners can be made sharper as well.

Regardless of whether the panels are provided separately or attached to other panels as part of the structure, the structures of the present invention may be conveniently folded and collapsed, thereby making them convenient to move around, and requiring little storage space. If the panels are provided separately, the individual further derives an additional variety of play since he or she can create structures of different shapes.

Thus, the present invention provides collapsible structures which provide the player with an unlimited source and variety of fun and entertainment. The shapes and sizes of the panels and the structures can be varied or combined, as well as the entertainment features.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. A collapsible structure comprising:

a central panel having a left side and a right side;

a first support connected to the left side of the central panel;

a second support connected to the right side of the central panel; and wherein the central panel comprises a foldable frame member having a folded and an unfolded orientation, and a fabric material substantially covering the frame member.

2. The structure of claim 1, wherein the first and second supports are disengageably connected to the central panel.

3. The structure of claim 1, wherein each of the supports and the central panel includes a bottom surface, and wherein the bottom surfaces of the central panel and supports rest on a surface or float on water when the structure is in an upright position, with the central panel disposed at right angles to and between the supports.

4. The structure of claim 3, further comprising a basket connected to the central panel.

5. The structure of claim 1, wherein the first and second supports are flotation devices.

6. A collapsible structure comprising:

a first panel having a left side and a right side;

a second panel having a left side and a right side;

a first support connected to the left sides of the first and second panels;

a second support connected to the right sides of the first and second panels; and wherein each of the first and second panels comprises a foldable frame member having a folded and an unfolded orientation, and a fabric material substantially covering the frame member.

7. The structure of claim 6, wherein each of the first and second panels includes a top side that is coupled to the top side of the other of the first or second panel.

8. The structure of claim 6, wherein the first and second supports are disengageably connected to the first and second panels.

9. The structure of claim 6, wherein each of the supports and the panels includes a bottom surface, and wherein the bottom surfaces of the panels and supports rest on a surface or float on water when the structure is in an upright position, with the panels disposed at right angles to and between the supports.

10. The structure of claim 6, further comprising a basket connected to the first panel.

11. The structure of claim 6, wherein the first and second supports are flotation devices.

12. The structure of claim 7, wherein the first and second panels are disposed at an angle with respect to each other when the structure is in an upright position.

13. The structure of claim 6, wherein the panels are foldable on top of each other about their connection to have the panels overlaying each other, and with the panels collapsible to the folded orientation by twisting and folding to form a plurality of concentric rings and layers of panels to substantially reduce the size of the panels in the folded orientation.

* * * * *